US010738670B2

(12) United States Patent
Tanaka et al.

(10) Patent No.: US 10,738,670 B2
(45) Date of Patent: Aug. 11, 2020

(54) UTILITY VEHICLE

(71) Applicant: KAWASAKI JUKOGYO KABUSHIKI KAISHA, Kobe-shi, Hyogo (JP)

(72) Inventors: Shinichi Tanaka, Akashi (JP); Jun Takagi, Himeji (JP); Yoko Yasui, Akashi (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 43 days.

(21) Appl. No.: 16/157,524

(22) Filed: Oct. 11, 2018

(65) Prior Publication Data

US 2020/0116056 A1 Apr. 16, 2020

(51) Int. Cl.

| | |
|---|---|
| ***F02M 13/04*** | (2006.01) |
| ***F01M 13/04*** | (2006.01) |
| ***F02M 35/16*** | (2006.01) |
| ***F02M 35/10*** | (2006.01) |
| ***F02M 35/04*** | (2006.01) |

(52) U.S. Cl.

CPC ..... *F01M 13/04* (2013.01); *F02M 35/044* (2013.01); *F02M 35/10006* (2013.01); *F02M 35/162* (2013.01)

(58) Field of Classification Search

CPC ..... F01M 13/04; F01M 2013/0461; F01M 13/00; F01M 2013/0488; F01M 11/02; F01M 13/022; F01M 11/08; F01M 1/10; F01M 2013/0038; F01M 11/03; F01M 13/0405; F01M 11/00; F01M 11/065; F01M 11/067; B01D 45/08; B01D 46/0031; B01D 2279/60; F02M 25/06; F02M 35/164

USPC ..... 123/572–574

See application file for complete search history.

(56) References Cited

U.S. PATENT DOCUMENTS

| | | | | |
|---|---|---|---|---|
| 2,896,743 A * | 7/1959 | Bradshaw | B01D 45/08 55/308 |
| 5,899,186 A * | 5/1999 | Kawamoto | B63B 34/10 123/196 R |
| 6,536,211 B1 * | 3/2003 | Borgstrom | B01D 45/14 60/311 |
| 6,755,173 B1 * | 6/2004 | Yoshida | F01M 11/02 123/196 W |

(Continued)

OTHER PUBLICATIONS

Ryan Manson, "Venting to Cure Crankshaft Pressure", May 13, 2014; Hotrod.com (Year: 2014).*

*Primary Examiner* — George C Jin
*Assistant Examiner* — Teuta B Holbrook

(57) ABSTRACT

A utility vehicle includes: an engine which is a drive source; a catch tank configured to perform a gas-liquid separation of a blow-by gas generated in the engine; a first breather passage configured to deliver the blow-by gas, which is discharged from the engine, to the catch tank; a second breather passage configured to supply a gas component, which has been separated in the catch tank, to an air intake system of the engine; and a return passage configured to return a liquid component, which has been separated in the catch tank, to the engine. The catch tank is disposed above a cylinder head covering. A breather outlet port, with which the first breather passage is fluid connected, and an oil return port, with which the return passage is fluid connected, are formed in an upper surface of the cylinder head covering.

7 Claims, 7 Drawing Sheets

(56) References Cited

U.S. PATENT DOCUMENTS

2009/0224565 A1* 9/2009 Hamaguchi ..... B60R 7/06 296/37.12
2009/0266346 A1* 10/2009 Wagner ..... F01M 9/02 123/573
2010/0071676 A1* 3/2010 Arvan ..... F01M 13/0405 123/573
2010/0126479 A1* 5/2010 Shieh ..... F01M 13/04 123/573
2012/0247438 A1* 10/2012 Konohara ..... F01M 13/022 123/559.1
2012/0297980 A1* 11/2012 Slaughter ..... B01D 45/08 95/272
2013/0276742 A1* 10/2013 Mallett ..... F01M 7/00 123/196 R
2014/0109533 A1* 4/2014 Horiuchi ..... F01M 13/04 55/430
2014/0366856 A1* 12/2014 Kakinai ..... F02M 25/08 123/574
2015/0267633 A1* 9/2015 Nakano ..... F01M 11/10 73/114.77
2015/0354420 A1* 12/2015 Kira ..... F02F 7/006 123/574
2016/0032819 A1* 2/2016 Bruestle ..... F02B 75/065 440/88 L
2016/0115911 A1* 4/2016 Newman ..... F01M 13/02 123/568.11
2016/0312686 A1* 10/2016 Christian ..... F01M 13/04
2017/0246568 A1* 8/2017 Sugio ..... B01D 45/08
2017/0274303 A1* 9/2017 Robison ..... B01D 35/005
2017/0362975 A1* 12/2017 Konishi ..... F02B 75/22
2018/0140984 A1* 5/2018 Janssen ..... B04B 1/04
2019/0032528 A1* 1/2019 Sprickmann Kerkerinck ..... F01M 11/065
2019/0055865 A1* 2/2019 Nakamura ..... F01M 13/0011
2019/0210039 A1* 7/2019 Kuhn ..... B04B 5/005
2019/0316513 A1* 10/2019 Takano ..... F01M 13/04
2019/0336799 A1* 11/2019 Montgomery ..... A62B 23/02

* cited by examiner

UTILITY VEHICLE

BACKGROUND OF THE INVENTION

Field of the Invention

The present invention relates to a breather structure for an engine used on an all-terrain utility vehicle that can be driven on any road regardless of geographical land features.

Description of Related Art

Blow-by gas generated in the engine contains air pollution substances such as, for example, unburned hydrocarbon. Therefore, gas-liquid separation of the blow-by gas is carried out, and the resultant gas components are supplied to an intake system of the engine and is then supplied to the combustion chamber together with an intake air. The liquid component so separated is returned to the interior of the engine by the effect of gravity.

The gas-liquid separation of the blow-by gas takes place within a breather chamber defined in the engine main body. Such a breather chamber has a labyrinth structure. However, the provision of the breather chamber within the engine main body results in complication of the engine structure. Also, where the breather chamber is provided in the engine main body, it is difficult to secure a space in which the breather chamber of a size effective to exhibit a sufficient gas-liquid separation effect is defined.

In a wheeled vehicle, such as, for example, a utility vehicle, of a kind having an ample space around the engine, the use may be made of a catch tank for a breather that is separate from the engine main body, and such a catch tank may be disposed at a location rearwardly of or laterally of the engine main body. However, since the catch tank is disposed at a location lower in level than the top surface of the cylinder head, return of the liquid component, which has been so separated, back to the engine main body is limited.

In view of the foregoing, the present invention has its principal object to provide a utility vehicle equipped with a breather structure capable of efficiently accomplishing a gas-liquid separation.

In order to accomplish the above described object of the present invention, a utility vehicle comprises: an engine which is a drive source; a catch tank disposed above a cylinder head covering of the engine and configured to perform a gas-liquid separation of a blow-by gas generated in the engine; a first breather passage configured to deliver the blow-by gas, which is discharged from the engine, to the catch tank; a second breather passage configured to supply a gas component, which has been separated in the catch tank, to an air intake system of the engine; and a return passage configured to return a liquid component, which has been separated in the catch tank, to the engine, in which vehicle a breather outlet port, with which the first breather passage is fluid connected, and an oil return port, with which the return passage is fluid connected, are formed in an engine main body of the engine, and the breather outlet port and the oil return port are positioned beneath the catch tank. The breather outlet port and the oil return port are formed on, for example, an upper surface of the cylinder head covering. The "utility vehicle" referred to above and hereinafter is to be understood as meaning an all-terrain vehicle which is also called a four wheeled buggy and which is capable of running on any type of passage way regardless of such geographical land.

According to the above described construction, since the catch tank is provided outside the engine, the size of the catch tank can be increased. Accordingly, since the passage within the catch tank can be formed to have a large size, the velocity of the blow-by gas flowing through the passage is lowered. As a result, the gas-liquid separation is expedited. Also, since the catch tank is disposed above the oil return port, the separated liquid component can be easily returned to the engine by the effect of its own weight.

In the present invention, the utility vehicle may also comprises a loading platform disposed above the engine, in which case the catch tank may be fitted to the loading platform. According to this construction, the catch tank can be stably supported by the loading platform which is robust.

Where the catch tank is fitted to the loading platform, the loading platform may be made of resin material, and the loading platform may be formed integrally with a bracket, and the catch tank may be fitted to the bracket. According to this construction, while increase of the number of component parts is suppressed, the catch tank can be supported on the loading platform with a simple structure.

Also, where the catch tank is fitted to the loading platform, the catch tank may be fitted to a front surface of the loading platform, the breather outlet port and the oil return port may be formed in an upper surface of the cylinder head covering, and the cylinder head covering may be positioned immediately beneath the catch tank. It is to be noted that the wording "positioned immediately beneath the catch tank" is intended to mean the position of the catch tank as viewed in a plane with at least a portion of the catch tank overlapping at least a portion of the cylinder head covering. According to this construction, while avoiding the catch tank from becoming conspicuous when viewed from side, the catch tank can be disposed at a site easily accessible from the lateral side of the vehicle body. Therefore, reduction in appearance of the vehicle body can be prevented by making the catch tank to be less conspicuous, and also, a good maintenance capability can also be appreciated. Also, the first breather passage and the return passage can be shortened.

In the present invention, the utility vehicle may further comprise: an air cleaner configured to filtrate an outside air; an air intake chamber disposed on a downstream side of the air cleaner with respect to a direction of flow of an intake air and configured to accumulate an intake air which has been filtered; and a throttle body disposed on a downstream side of the air intake chamber with respect to the direction of flow of the intake air and configured to adjust an amount of air to be supplied to the engine, in which case the second breather passage may be fluid connected with the air intake chamber. According to this construction, the air intake chamber is provided at a site closer to the throttle body than to the air cleaner and, therefore, the negative pressure is high. Accordingly, the separated gas component can be smoothly introduced into the air intake chamber.

In the present invention, a curved passage, which is once or more curved, may be formed within an interior of the catch tank. In this case, an angle of curvature of the curved passage may be within the range of 120° to 160°. According to this construction, since the blow-by gas collides against a curved passage wall, the gas-liquid separation of the blow-by gas can be accelerated.

In the present invention, the catch tank may be a resin blow molded article. According to this construction, the catch tank, which is lightweight, can be easily formed at a low cost.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Figure 1:
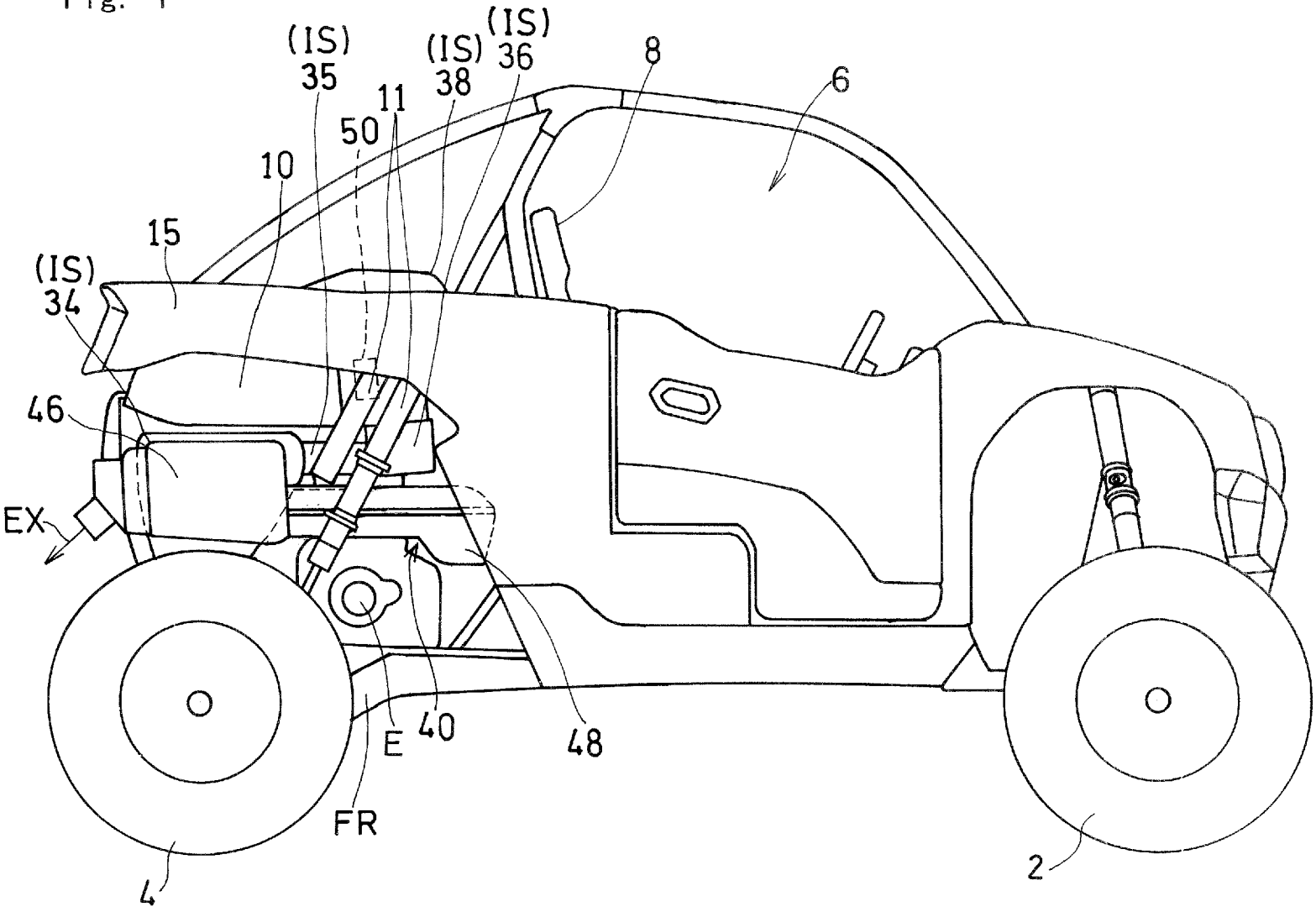
FIG. 1 is a side view showing a utility vehicle according to a first preferred embodiment of the present invention.

Hereinafter, the preferred embodiment of the present invention will be described in detail with particular reference to the accompanying drawings. It is, however, to be noted that in the description of the preferred embodiment of the present invention the terms "left" and "right" or similar notations that are hereinabove and hereinafter used, are to be understood as meaning relative terms descriptive of positions and/or directions as viewed from a vehicle rider occupying the seat. FIG. 1 illustrates a side view of a utility vehicle designed in accordance with a first preferred embodiment of the present invention. The term "utility vehicle" referred to above and hereinafter means an all-terrain vehicle which is also called a four wheeled buggy and which is capable of running on any type of passage way regardless of such geographical land features as muddy land, sand beach and snowy road. The utility vehicle referred to above and hereinafter is used in various applications such as, for example, leisure and works.

The wheeled vehicle referred to the description of the preferred embodiment is provided with a driver's cabin 6 defined between front wheels 2 and rear wheels 4. The driver's cabin 6 has a seat 8 defined therein for a driver to sit on. A loading platform 10 is provided rearwardly of the driver's cabin 6 and above the rear wheels 4. The loading platform 10 employed in the practice of the present embodiment is made of resin material. A region above the loading platform 10 is covered by a rear side covering 15 from lateral outside. An engine E, which is a drive source, is disposed rearwardly of the seat 8 and beneath the loading platform 10. In other words, the loading platform 10 is disposed above the engine E.

The engine E referred to in the description of the embodiment now under discussion is a two cylinder four cycle engine. It is, however, to be noted that the engine E may not be necessarily limited to the two cylinder engine, but the engine E may be a single cylinder engine or the engine E may have three or more cylinders. This engine E is supported by a vehicle body frame structure FR. The engine E is disposed between the left and right rear wheels 4. Specifically, the engine E is disposed between rear suspensions 11 and 11 for the respective left and right rear wheels 4 and 4.

Figure 2:
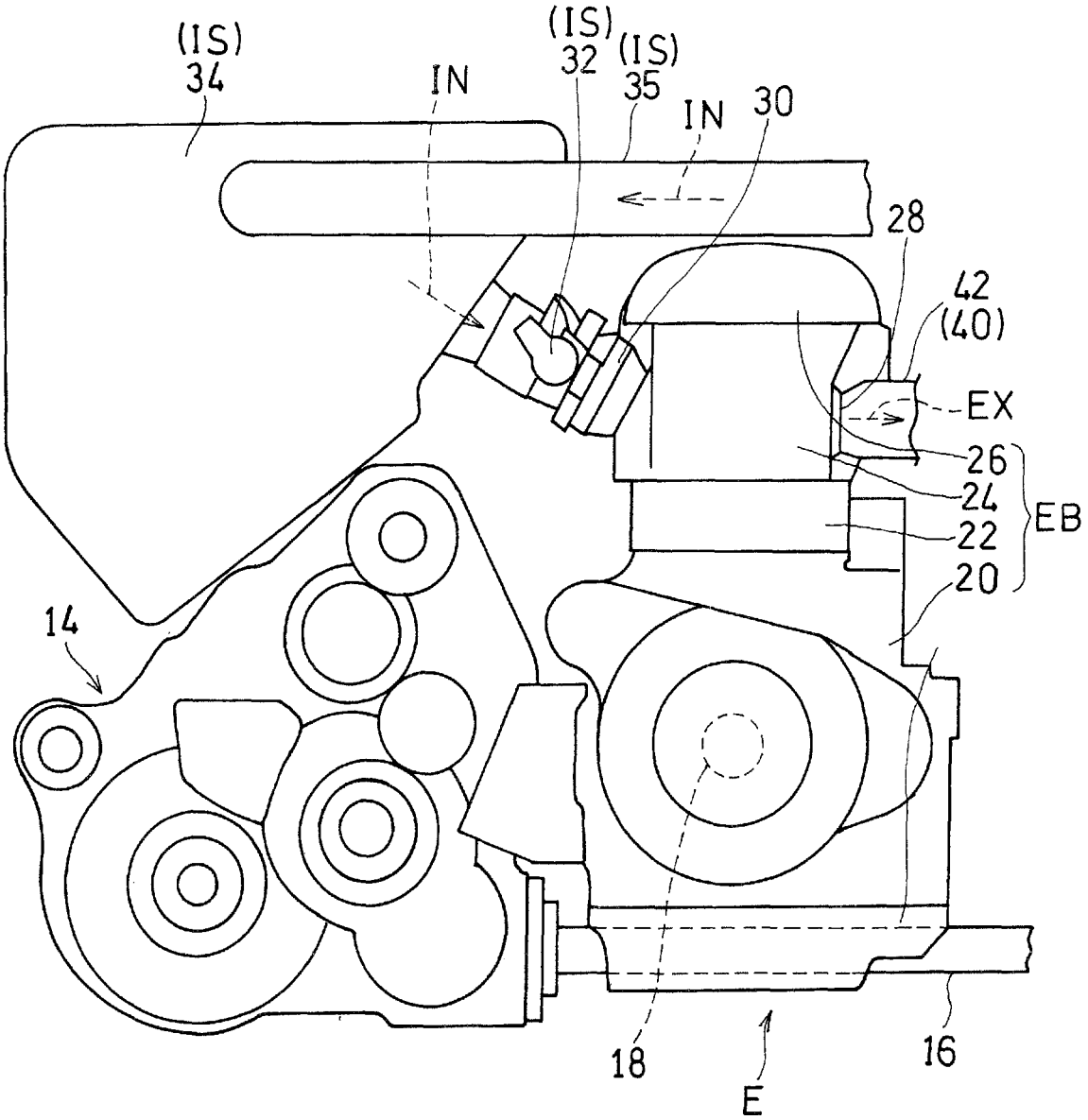
FIG. 2 is a side view showing an engine used in the utility vehicle.

The wheeled vehicle referred to in the description of the embodiment now under discussion is a four wheel drive vehicle. Specifically, the rotative power generated by the engine E is transmitted to the rear wheel 4 (FIG. 1) through a continuously variable transmission (not shown), disposed on a right side of the engine E, and a gear box 14 shown in FIG. 2. Also, the rotative power of the engine E is transmitted to a front wheel 2 by way of a drive shaft 16. It is, however, to be noted that the utility vehicle referred to the description of the present invention may not be necessarily limited to the four wheel drive vehicle, but may be equally applied to a two wheel drive vehicle.

The engine E includes: a crankshaft 18 extending in a direction parallel to a vehicle widthwise direction; a crankcase 20 supporting the crankshaft 18, a cylinder 22 protruding upwardly from the crankcase 20; a cylinder head 24 defined in an upper portion of the cylinder 22; and a cylinder head covering 26 mounted atop the cylinder head 24. The crankcase 20, the cylinder 22, the cylinder head 24 and the cylinder head covering 26 cooperate with each other to define an engine main body EB. An exhaust port 28 is formed in a front surface of the cylinder head 24, and an air intake port 30 is formed in a rear surface of the cylinder head 24. The exhaust port 28 and the air intake port 30 are each employed two in number and juxtaposed relative to each other in a direction parallel to the vehicle widthwise direction.

A throttle body 32 is fluid connected with the air intake port 30. The throttle body 32 is operable to adjust an amount of air to be supplied to the engine E and also to form an air-fuel mixture by injecting fuel into the intake air. The throttle body 32 has an inlet port with which a discharge port of an air intake chamber 34 is fluid connected. The air intake chamber 34 accumulates an intake air IN to be supplied to the engine E. The air intake chamber 34 is disposed at a location rearwardly of the cylinder head 24 and above the gear box 14. The intake air IN from an air cleaner 36 shown in FIG. 1 is supplied to the air intake chamber 34 through an air intake tube 35.

The air cleaner 36 forms the intake air (cleaned air) IN by filtering air introduced from an air intake duct 38. The air intake chamber 34 is disposed on a downstream side of the air cleaner 38 with respect to a direction of flow of the intake air and is operable to accumulate the filtered intake air IN. The throttle body 32 is disposed on a downstream side of the air intake chamber 34 with respect to the direction of flow of the intake air, and is fluid connected with the air intake port 30 of the engine E. The intake air duct 38, the air cleaner 36, the air intake tube 35, the air intake chamber 34 and the throttle body 32 cooperate with each other to form an air intake system IS of the engine E.

The exhaust port 28 is fluid connected with an exhaust device 40. The exhaust device 40 includes: two exhaust pipes 42 and 42 (FIG. 2) each fluid connected with the respective exhaust port 28; a single collecting tube (not shown) by which the two exhaust pipes 42 and 42 are collected together at a location downstream thereof; and a muffler 46 fluid connected with a downstream end of the collecting tube. In other words, exhaust gases EX from the engine E are introduced into the muffler 46 through the exhaust pipe 42 and the collecting tube, and then are, after having been silenced within the muffler 46, discharged to the outside. The exhaust pipe 42 and the collecting tube are covered by an exhaust covering 48.

Figure 3:
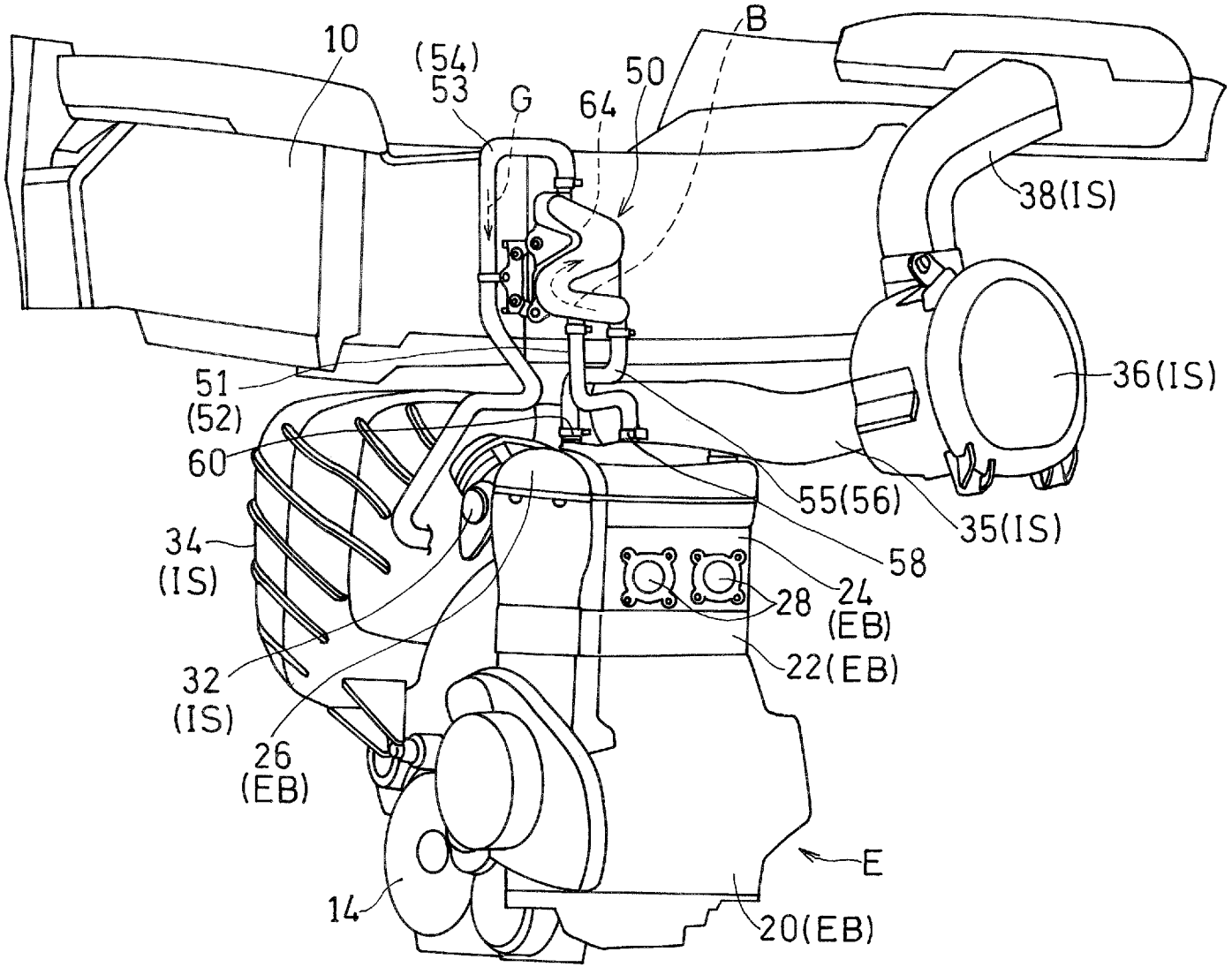
FIG. 3 is a perspective view showing a rear portion of the utility vehicle.

As shown in FIG. 3, a catch tank 50 is disposed in a region upwardly of the cylinder head covering 26 of the engine E. The catch tank 50 is fitted to the loading platform 10. Specifically, the catch tank 50 is removably fitted to a front surface of the loading platform 10. The catch tank 50 carries out a gas-liquid separation of the blow-by gas B emanating from the engine E.

In other words, the blow-by gas B discharged from the engine E is introduced into the catch tank 50 through a first breather passage 52, followed by the gas-liquid separation taking place within the catch tank 50. A gas component G separated within the catch tank 50 is subsequently supplied to the air intake chamber 34 for the engine E through a second breather passage 54. On the other hand, a liquid component L separated within the catch tank 50 is returned to the engine main body EB through a return passage 56. The catch tank 50 and the passages 52, 54 and 56 altogether cooperate to form a breather structure of the engine E.

More specifically, the engine main body EB and the catch tank 50 are fluid connected with each other by means of a first breather tube 51, and this first breather tube 51 forms the first breather passage 52. Also, the catch tank 50 and the air intake chamber 34 are fluid connected with each other by means of a second breather tube 53, and this second breather tube 53 forms the second breather passage 54. Yet, the catch tank 50 and the engine main body EB are fluid connected with each other by means of a return tube 55, and this return tube 55 forms the return passage 56. Each of the first breather tube 51, the second breather tube 53 and the return tube 55 is employed in the form of a rubber tube. It is, however, to be noted that each of those tubes 51, 53 and 55 may not be necessarily limited to the rubber tube.

The first breather tube 51 and the return tube 55 are fluid connected with the cylinder head covering 26. Specifically, the upper surface of the cylinder head covering 26 is formed with a breather outlet port 58 and an oil return port 60. The first breather tube 51 is fluid connected with the breather outlet port 58, and the return tube 55 is fluid connected with the oil return port 60. Although in the practice of the embodiment now under discussion, the breather outlet port 58 and the oil return port 60 have been shown and described as formed in the upper surface of the cylinder head covering 26, the breather outlet port 58 and the oil return port 60 may not be necessarily formed as shown and described, but the breather outlet port 58 and the oil return port 60 may be formed in the engine main body EB.

Figure 4:
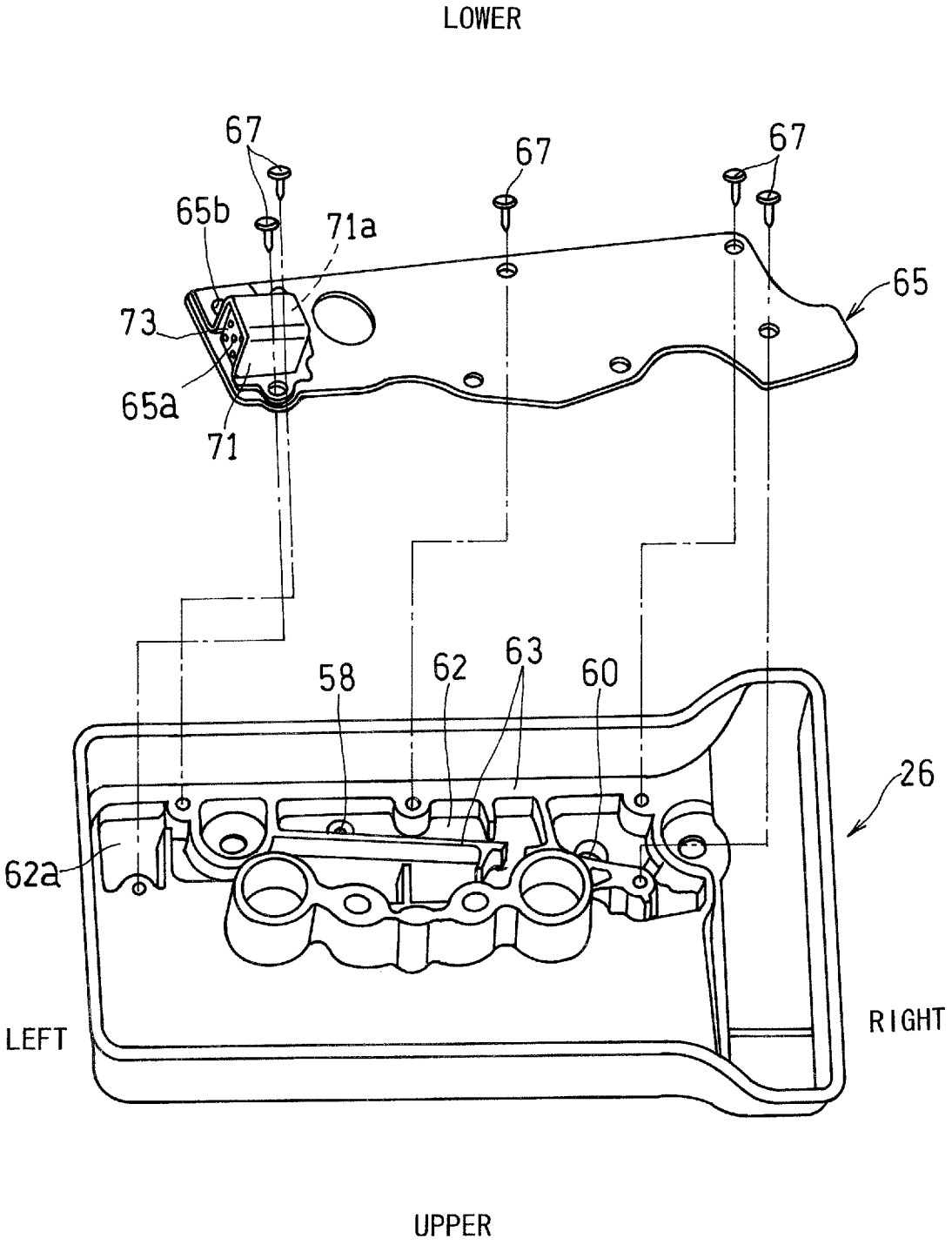
FIG. 4 is a perspective view showing a cylinder head covering for the engine as viewed from inside.

FIG. 4 illustrates a perspective view showing the cylinder head covering 26 as viewed from inside thereof. As shown in FIG. 4, within the interior of the cylinder head covering 26, a protruding wall 63 for defining a breather chamber 62 is formed. Specifically, a plate 65 in the form of a sheet metal is fitted to an inner surface of the cylinder head covering 26 by means of a plurality of threaded bodies 67, and the breather chamber 62 is defined between the cylinder head covering 26 and the plate 65.

The plate 65 is formed with a first communicating port 65*a* open in a horizontal direction (towards a left side in FIG. 4) and a second communicating port 65 open downwardly. The plate 65 has an undersurface to which an inlet defining member 71, which is downwardly swollen, is fitted. By the presence of this inlet defining member 71, an inlet space 71*a* is formed at a location beneath an upstream end 62*a* of the breather chamber 62. The inlet space 71*a* opens towards one horizontal direction (towards a left side in FIG. 4 in the case of the embodiment now under discussion), and a punched metal 73 is fitted to the opening. Through-holes defined in the punched metal 73 altogether form the first communicating port 65*a* referred to previously. The second communicating port 65*b* is in the form of a through-hole defined in the plate 65 and is formed in the vicinity of the first communicating port 65*a*.

As mentioned above, the breather chamber 62 is defined between the cylinder head covering 26 and the plate 65. The breather chamber 62 has a labyrinth structure and is communicated with the interior of the engine E through the first and second communicating ports 65*a* and 65*b*. The breather outlet port 58 is communicated with the breather chamber 62.

The blow-by gas B leaking from the engine E flows, from the first and second communicating ports 65*a* and 65*b* defined in the plate 56, into the upstream end 62*a* of the breather chamber 62. The gas-liquid separation of the blow-by gas B so introduced into the breather chamber 62 takes place as the blow-by gas B flows through the breather chamber 62 within the cylinder head covering 26. The blow-by gas B having been passed through the breather chamber 62 is discharged from the breather outlet port 58 into the first breather passage 52 situated outside of the engine E shown in FIG. 3. On the other hand, oil introduced into the interior through the oil return port 60 is returned from the second communicating port 65*b* in the plate 65 into the engine interior.

Figure 5:
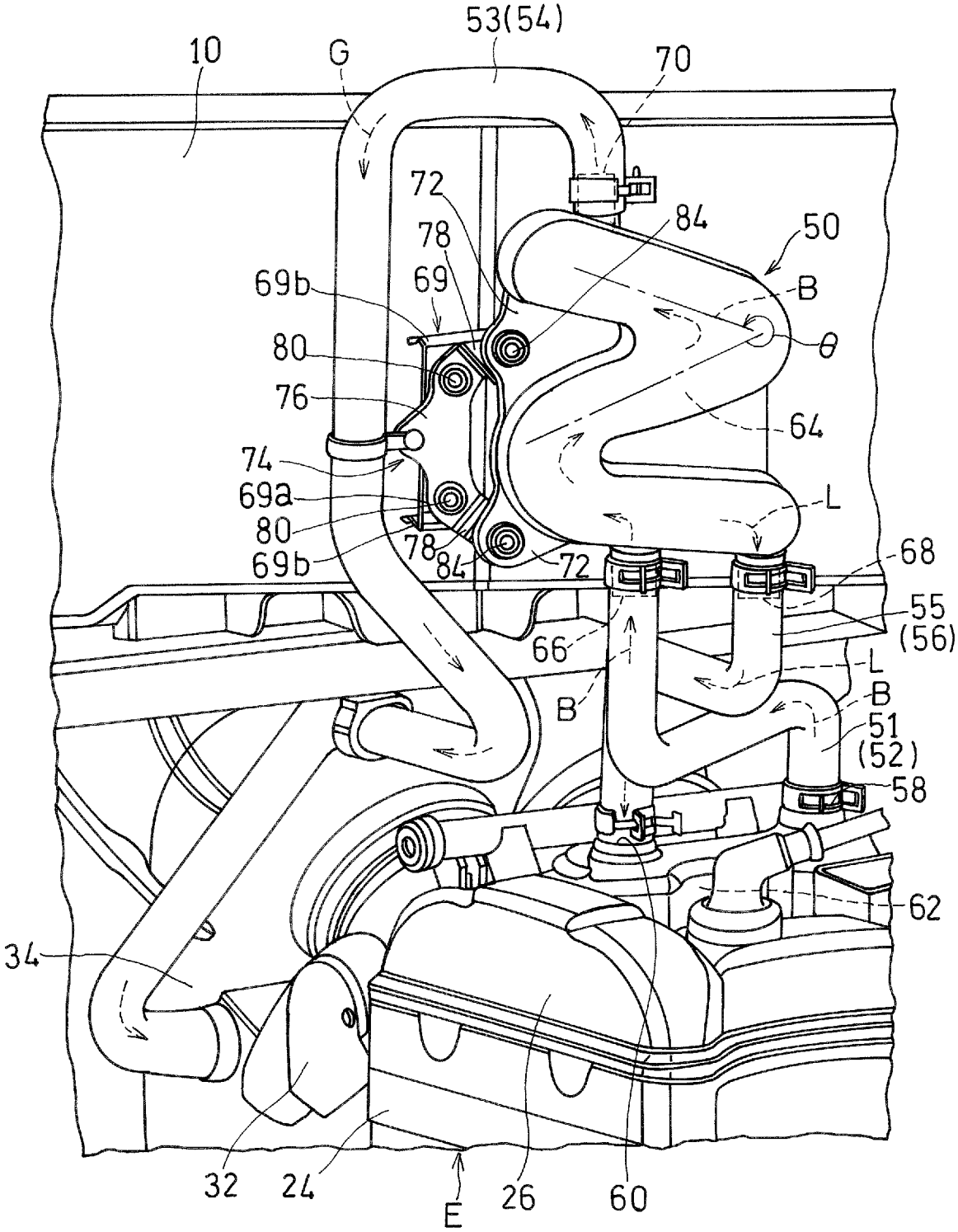
FIG. 5 is a perspective view showing a breather structure used in the utility vehicle.

As shown in FIG. 5, the catch tank 50 is disposed right above the cylinder head covering 26. In other words, the cylinder head covering 26 is positioned immediately beneath the catch tank 50. It is to be noted that the wording "positioned immediately beneath the catch tank 50" is intended to mean the position of the catch tank 50 as viewed in a plane with at least a portion of the catch tank 50 overlapping at least a portion of the cylinder head covering 26.

Within the interior of the catch tank 50, an inner tank passage 64 is formed. The catch tank 50 employed in the practice of the embodiment now under discussion is a blow molded article made of resin material. The material for the catch tank 50 is, for example, PA6 (Nylon 6). It is, however, to be noted that the material for the catch tank 50 may not be necessarily limited to PA6 (Nylon 6), but it may be, for example, polypropylene, polyethylene or the like.

The inner tank passage 64 employed in the practice of the embodiment now under discussion is in the form of an S-shaped bent passage 64 having been twice bent. The angle of each of the curves in the bent passage 64 is, for example, within the range of 120° to 160°. In the practice of the embodiment now under discussion, the angle of the lower side curve of the bent passage 64 is so chosen as to be about 155° and the angle of the upper side curve of the bent passage 64 is so chosen as to be about 135°. With the inner tank passage 64 so curved as described above, the gas-liquid separation can be accelerated as the blow-by gas B then flowing within the passage collides against the passage wall. Although in the practice of the embodiment now under discussion, the bent passage 64 has been shown and described as twice bent, attention is called that the gas-liquid separation can be equally accelerated even with one curve in the inner tank passage 64.

The catch tank 50 has a lower portion formed with a gas inlet portion 66 and an oil return portion 68. The gas inlet portion 66 and the oil return portion 68 are each in the form of a cylindrical projection that protrudes downwardly with its cylindrical hollow communicated with the inner tank passage 64.

The first breather tube 51 referred to above is set in the outer periphery of the cylindrical gas inlet portion 66. Accordingly, the first breather passage 52 is communicated with the inner tank passage 64. On the other hand, the return tube 55 is set in the outer periphery of the cylindrical oil return portion 68. Accordingly, the inner tank passage 64 and the oil return port 60 are fluid connected with each other through the return passage 56.

The catch tank 50 has an upper end portion formed with a gas outlet portion 70. The gas outlet portion 70 is in the form of a cylindrical projection protruding upwardly and has a hollow thereof communicated with the inner tank passage 64. The second breather tube 53 referred to above is set in the outer periphery of the cylindrical gas outlet portion 70. Accordingly, the second breather passage 54 is communicated with the inner tank passage 64. The second breather tube 53 is, after having extended upwardly, bent so as to extend downwardly and is subsequently fluid connected with the air intake chamber 34.

The catch tank 50 has a plate shaped fitting piece 72 formed therein. In the practice of the embodiment now under discussion, the fitting piece 72 is employed two in number and is positioned on a lateral side portion of the catch tank with respect to the vehicle widthwise direction, the two fitting pieces 72 being juxtaposed in a vertical direction relative to each other. However, the position and the number of the fitting piece 72 may not be necessarily limited to those described and shown. Each of the fitting pieces 72 is formed with a respective bolt insertion hole 72*a* oriented in a forward and rearward direction.

The front surface of the loading platform 10 is provided with a first bracket 69. In the practice of the embodiment now under discussion, the first bracket 69 is formed integrally with the loading platform 10 by the use of a resin mold forming technique. Specifically, the first bracket 69 includes: a fitting portion 69*a* which extends parallel to the front surface of the loading platform 10 and is elongated in the vertical direction; and a plurality of connecting portions 69*b* and 69*b* for connecting between the front surface of the loading platform 10 and upper and lower ends of the fitting piece 69*a*. The fitting portion 69*a* is formed with two fitting holes 69*c* (FIG. 6) oriented in the frontward and rearward direction and juxtaposed relative to each other in the vertical direction.

The catch tank 50 is fitted to the first bracket 69 defined in the loading platform 10 through a second bracket 74. The second bracket 74 is formed by bending a sheet metal. Specifically, the second bracket 74 includes: a to-be-supported portion 76, which is supported by the first bracket 69; and a tank supporting portion 78 configured to support the catch tank 50.

Figure 6:
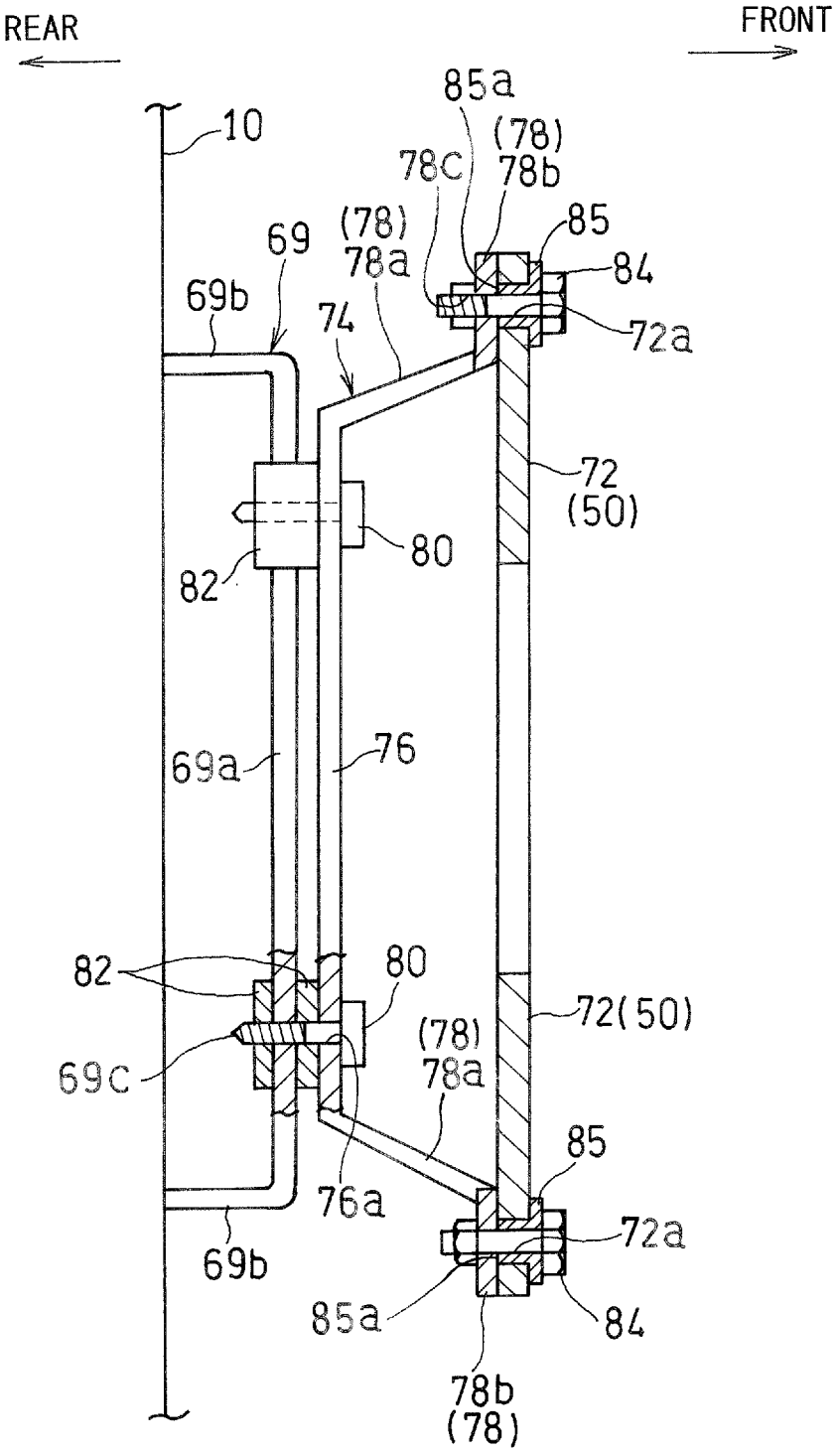
FIG. 6 is a sectional view showing a mounting structure of a catch tank in the utility vehicle.

The to-be-supported portion 76 is of such a shape as to extend in the vertical direction along the fitting portion 69*a* of the first bracket 69 shown in FIG. 6. Upper and lower portions of the to-be-supported portion 76 are formed with respective insertion holes 76*a* that are oriented in the frontward and rearward direction. The insertion hole 76*a* is provided at a position corresponding to the fitting hole 69*c* of the first bracket 69.

The tank supporting portion 78 includes: an extension portion 78*a*, which extends frontwards from each of the upper and lower ends of the to-be-supported portion 76; and a fitting portion 78*b* bent from the extension portion 78*a* so as to have a main surface that is oriented frontwards. For each fitting portion 78*b*, a threaded hole 78*c* is provided. The threaded hole 78*c* employed in the practice of the embodiment now under discussion is in the form of a welded nut. The threaded hole 78*c* is provided at a position corresponding to the bolt insertion hole 72*a* of the fitting piece 72 in the catch tank 50.

The second bracket 74 is fitted to the first bracket 69 by means of a threaded body 80. The threaded body 80 is in the form of, for example, a tapping screw. Specifically, a clamping nut 82 is mounted on the fitting portion 69*a* of the first bracket 69, and then, the threaded body 80 is inserted into the insertion hole 76*a* in the second bracket 74 and also into the fitting hole 69*c* in the first bracket 69 before the threaded body 80 is fastened to the clamping nut 82. It is to be noted that, in FIG. 5, the clamping nut 82 is not shown. It is, however, to be noted that a structure for connecting the first bracket 69 and the second bracket 74 may not be necessarily limited to that shown and described.

By means of a fastening member 84 such as, for example, a bolt, the catch tank 50 is fitted to the second bracket 74. Specifically, a flanged tubular collar 85 is inserted from frontwards of the vehicle body into the bolt insertion hole 72*a* defined in the fitting piece 72 of the catch tank 50. The collar 85 has a tip end 85*a* held in contact with the tank supporting portion 78 of the second bracket 74. The fastening member 84 is inserted from frontwards of the vehicle body into the hollow of the collar 85 and is then fastened to the threaded hole 78*c* of the second bracket 74. By so doing, the catch tank 50 is removably supported by the loading platform 10 (vehicle body) through the first and second brackets 69 and 74. It is, however, to be noted that the support structure for the catch tank 50 may not be necessarily limited to that shown and described.

In the description that follows, the flow of the blow-by gas B according to the embodiment now under discussion will be discussed with particular reference to FIG. 5. When the engine E is started, the blow-by gas B within the engine E is discharged to the outside of the engine E through the breather outlet port 58. The blow-by gas B is guided to the catch tank 50 through the first breather passage 52 in the first breather tube 51.

The blow-by gas B so guided to the catch tank 50 flows through the inner tank passage 64. Since the inner tank passage 64 represents the S-shaped configuration, the blow-by gas B collides against the passage wall when blow-by gas B flows through the inner tank passage 64. Accordingly, the blow-by gas B is separated into the gas component G such as, for example, oil mist, unburned hydrocarbon and others and the liquid component L such as, for example, water, oil and others.

The gas component G so separated is discharged, from the gas outlet portion 70 defined at the upper end of the catch tank 50, to the outside. The liquid component G so separated is introduced into the air intake chamber 34 through the second breather passage 54 in the second breather tube 53, and is then, burned within the combustion chamber in the engine E together with the intake air. On the other hand, the liquid component L falls to the bottom of the catch tank 50 by the effect of its own weight. This liquid component L is returned back to the engine main body EB by way of the oil return portion 68 at the bottom and then through the return passage 56 in the return tube 55.

According to the construction hereinabove described, since the catch tank 50 is provided outside the engine E, the catch tank 50 can have an increased size. Accordingly, the inner tank passage 64 within the catch tank 50 can be formed so as to have a large size and, therefore, the velocity of the blow-by gas B flowing through the inner tank passage 64 is lowered. As a result, the gas-liquid separation is expedited. Also, since the catch tank 50 is disposed above the cylinder head covering 26, the separated liquid component L can be easily returned to the engine E by the effect of its own weight.

Since the catch tank 50 is fitted to the loading platform 10, the catch tank 50 can be stably supported by the loading platform 10 that is robust. Also, the first bracket 69 is formed integrally with the loading platform 10 that is made of resin material, and the catch tank 50 is fitted to the first bracket 69. Accordingly, while increase of the number of components used is suppressed, the catch tank 50 can be supported on the loading platform 10 with a simplified structure.

The breather outlet port 58 and the oil return port 60 are formed in the upper surface of the cylinder head covering 26 and the cylinder head covering 26 is positioned immediately beneath the catch tank 50. Accordingly, the first breather passage 52 and the return passage 56 can be shortened. Also, as shown in FIG. 1, the upper portion of the catch tank 50 is covered from lateral outside by the rear side covering 15, and the rear suspension 11 is disposed laterally outside of the lower portion of the catch tank 50. Accordingly, when viewed from lateral side, the catch tank 50 can be prevented from being conspicuous.

Figure 7:
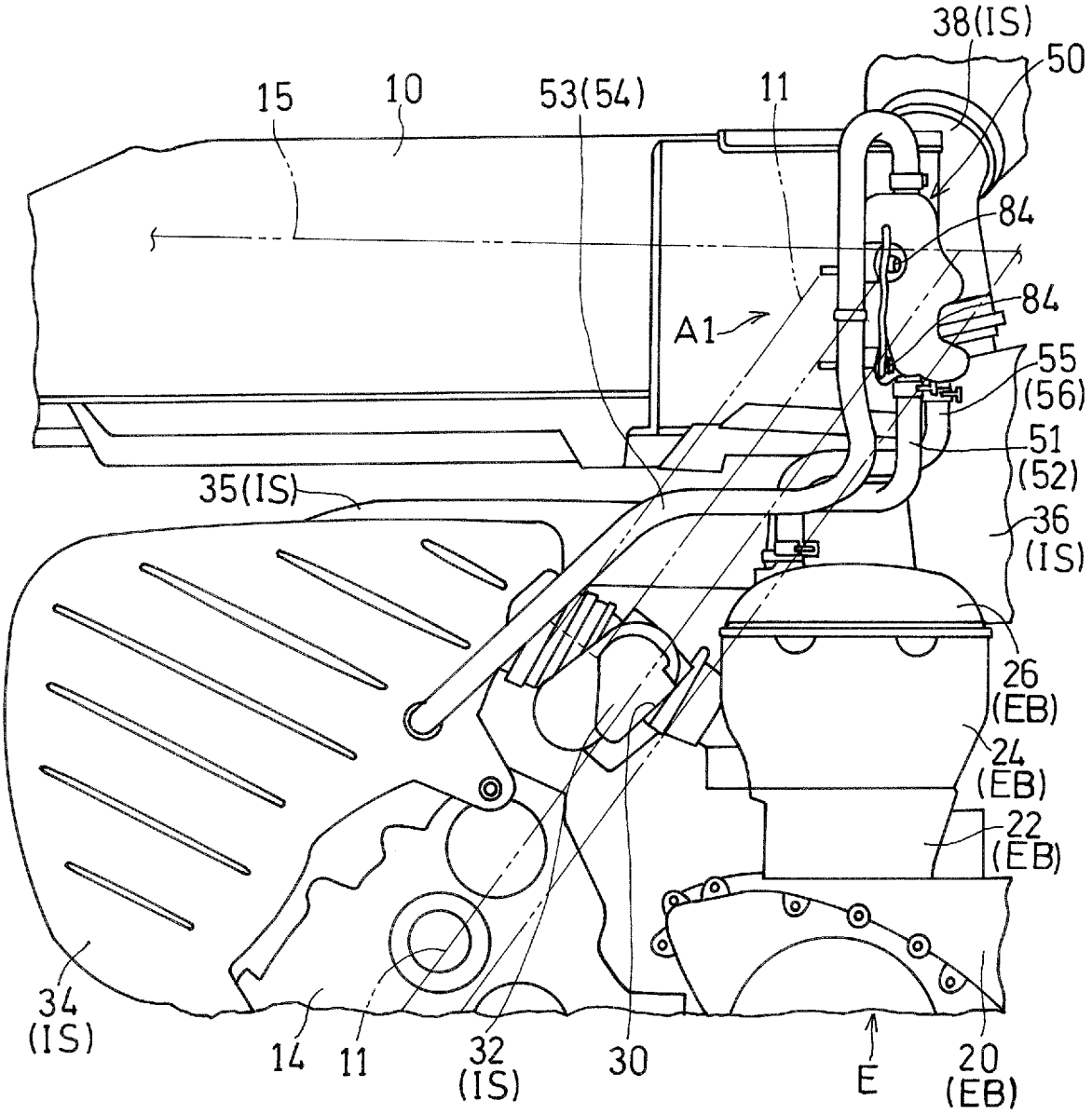
FIG. 7 is a side view showing the breather structure.

From diagonally rearwardly (from a direction indicated by the arrow A1) of the rear suspension 11 shown in FIG. 7, it is possible to look at the catch tank 50 with naked eyes and, by inserting the hand from the direction of the arrow A1, access is possible to the catch tank 50 from lateral side of the vehicle body. Accordingly, the fastening member 84 can be manipulated from lateral side of the vehicle body, and thus, the catch tank 50 can be easily fitted and removed relative to the vehicle body. Thus, in the practice of the embodiment hereinbefore fully described, reduction in appearance of the vehicle body can be prevented by making the catch tank 50 to be less conspicuous, and also, a good maintenance capability can also be appreciated.

The second breather passage 54 shown in FIG. 3 is fluid connected with the air intake chamber 34. Since the air intake chamber 34 is provided at a position closer to the throttle body 32 than to the air cleaner 36, the negative pressure is high. Accordingly, the separated gas component G can be smoothly introduced into the air intake chamber 34.

The inner tank passage 64 of the twice S-shaped configuration is formed within the interior of the catch tank 50. Accordingly, the blow-by gas B collides against the inner tank passage 64 that is curved and, therefore, the gas liquid separation of the blow-by gas B is expedited. Also, since the catch tank 50 is a resin blow molded article, the catch tank 50 that is lightweight can be formed at a low cost.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention.

By way of example, although in describing the foregoing embodiment of the present invention reference has been made to the two cylinder engine, the number of the cylinders may not be necessarily limited to two as referred to in the foregoing description, provided that the engine is a four cycle engine.

Also, although in describing the foregoing embodiment of the present invention the separated gas component G has been described and shown as introduced into the air intake chamber 34, gas component G may be introduced into the air cleaner 36.

Accordingly, such changes and modifications are, unless they depart from the scope of the present invention as delivered from the claims annexed hereto, to be construed as included therein.

REFERENCE NUMERALS

10 . . . Loading platform
26 . . . Cylinder head covering
32 . . . Throttle body
34 . . . Air intake chamber
36 . . . Air cleaner
50 . . . Catch tank
52 . . . First breather passage
54 . . . Second breather passage
56 . . . Return passage
58 . . . Breather outlet port
60 . . . Oil return port
64 . . . Inner tank passage (Curved passage)
69 . . . First bracket (Bracket)
B . . . Blow-by gas
E . . . Engine
IS . . . Air intake system

What is claimed is:

1. A utility vehicle which comprises:

an engine which is a drive source;

a catch tank disposed above a cylinder head covering of the engine and configured to perform a gas-liquid separation of a blow-by gas generated in the engine;

a loading platform disposed above the engine, the catch tank being fitted to a front vertically-oriented surface of the loading platform;

a first breather passage configured to deliver the blow-by gas, which is discharged from the engine, to the catch tank;

a second breather passage configured to supply a gas component, which has been separated in the catch tank, to an air intake system of the engine; and a return passage configured to return a liquid component, which has been separated in the catch tank, to the engine, wherein a breather outlet port, with which the first breather passage is fluid connected, and an oil return port, with which the return passage is fluid connected, are formed in an engine main body of the engine, and the breather outlet port and the oil return port are positioned beneath the catch tank.

2. The utility vehicle as claimed in claim 1, wherein:

the loading platform is made of resin material, and the loading platform is formed integrally with a bracket; and the catch tank is fitted to the bracket.

3. The utility vehicle as claimed in claim 1, wherein:

the breather outlet port and the oil return port are formed in an upper surface of the cylinder head covering; and the cylinder head covering is positioned immediately beneath the catch tank.

4. The utility vehicle as claimed in claim 1, further comprising:

an air cleaner configured to filtrate an outside air;

an air intake chamber disposed on a downstream side of the air cleaner with respect to a direction of flow of an intake air and configured to accumulate an intake air which has been filtered; and a throttle body disposed on a downstream side of the air intake chamber with respect to the direction of flow of the intake air and configured to adjust an amount of air to be supplied to the engine, wherein the second breather passage is fluid connected with the air intake chamber.

5. The utility vehicle as claimed in claim 1, wherein a curved passage, which is once or more curved, is formed within an interior of the catch tank.

6. The utility vehicle as claimed in claim 5, wherein an angle of curvature of the curved passage is within the range of 120° to 160°.

7. The utility vehicle as claimed in claim 1, wherein the catch tank is a resin blow molded article.

* * * * *